US005724679A

United States Patent [19]

Hans

[11] Patent Number: 5,724,679

[45] Date of Patent: Mar. 10, 1998

[54] ATHLETIC PANTS WITH BACK POCKET

[76] Inventor: Gerald L. Hans, 2624 Green Oak Pl., Los Angeles, Calif. 90068

[21] Appl. No.: 698,022

[22] Filed: Aug. 15, 1996

[51] Int. Cl.[6] ..... A41D 1/06; A41D 27/20

[52] U.S. Cl. ..... 2/238; 2/228; 2/249

[58] Field of Search ..... 2/238, 228, 227, 2/247, 249, 250, 252, 253, 67, 94

[56] References Cited

U.S. PATENT DOCUMENTS

| | | | |
|---|---|---|---|
| 3,744,059 | 7/1973 | Hayes | 2/250 |
| 3,871,030 | 3/1975 | Green | 2/238 |
| 4,079,871 | 3/1978 | Sica | 2/247 |
| 5,031,244 | 7/1991 | Inagaki | 2/94 |

OTHER PUBLICATIONS

Two pages of advertising from the Fleet Feet Conference at Squaw Valley, Lake Tahoe, California, held between Aug. 6–9, 1995.

List of franchisees pesent at the Fleet Feet Conference at Squaw Valley, Lake Tahoe, Calfornia, held between Aug. 6–9, 1995.

Letter dated Aug. 14, 1995 to Mr. Casey Long, Marketing Manager of Fleet Feet, Inc. from Mary Button and Gerry Hans.

Letter dated Aug. 16, 1995 from Casey Long, Marketing Manager of Fleet Feet, Inc., to Mary Button and Gerry Hans.

Press Release dated Aug. 24, 1995.

Packing list for order dated Aug. 29, 1995.

One copy each of two invoices.

Copy of the Fact Sheet for the 1995 Philadelphia Distance Run, Philadelphia, PA.

Photograph of prototype athletic pants.

LD Short, male style, #2001LD, size medium, color red.

Sport Europa Catalog; p. 42; item A; Supplex Shorts. Feb. 1,1995.

Sunbreak–Early winters–Spring 1995 Catalog. p.11, Mesh daypack.

*Primary Examiner*—Gloria Hale

*Attorney, Agent, or Firm*—Sol Goldstein Sheldon & Mak

[57] ABSTRACT

A pair of athletic pants is provided having a front panel, a back panel attached to the front panel and a pocket attached to the back panel. The pocket has an inner layer and an outer layer, the inner layer being composed of mesh. In a preferred embodiment, the outer layer is also composed of mesh.

9 Claims, 1 Drawing Sheet

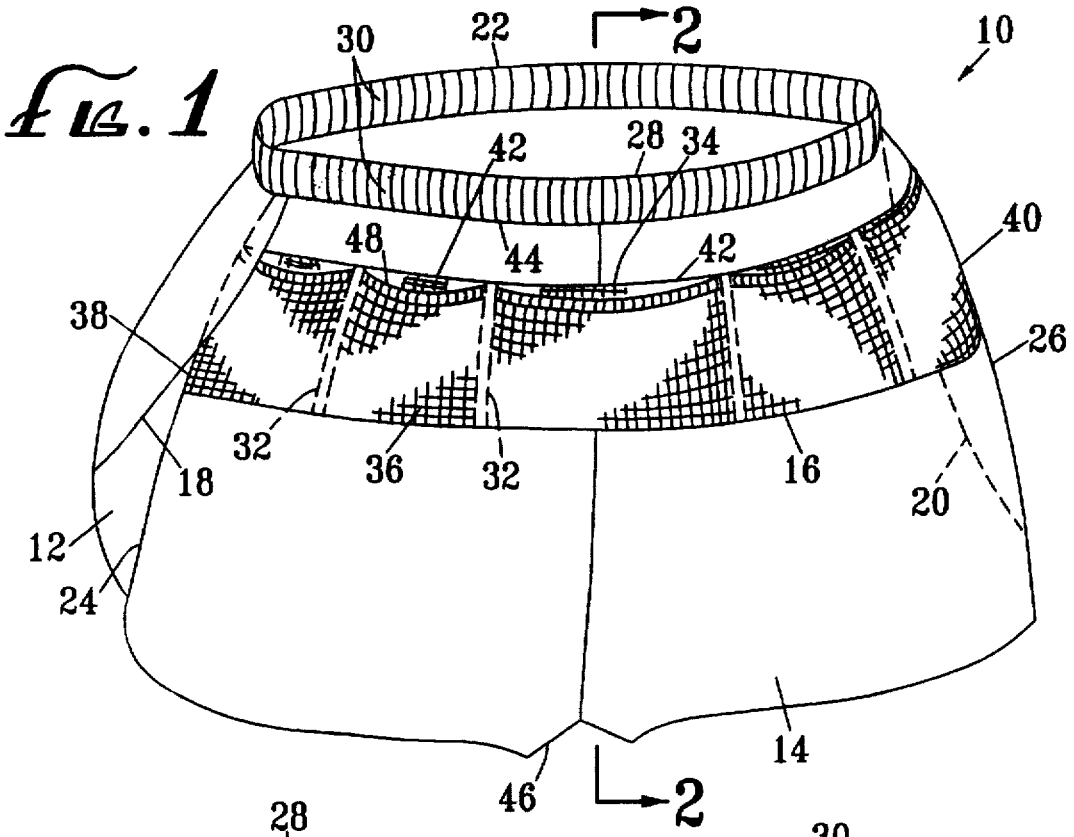
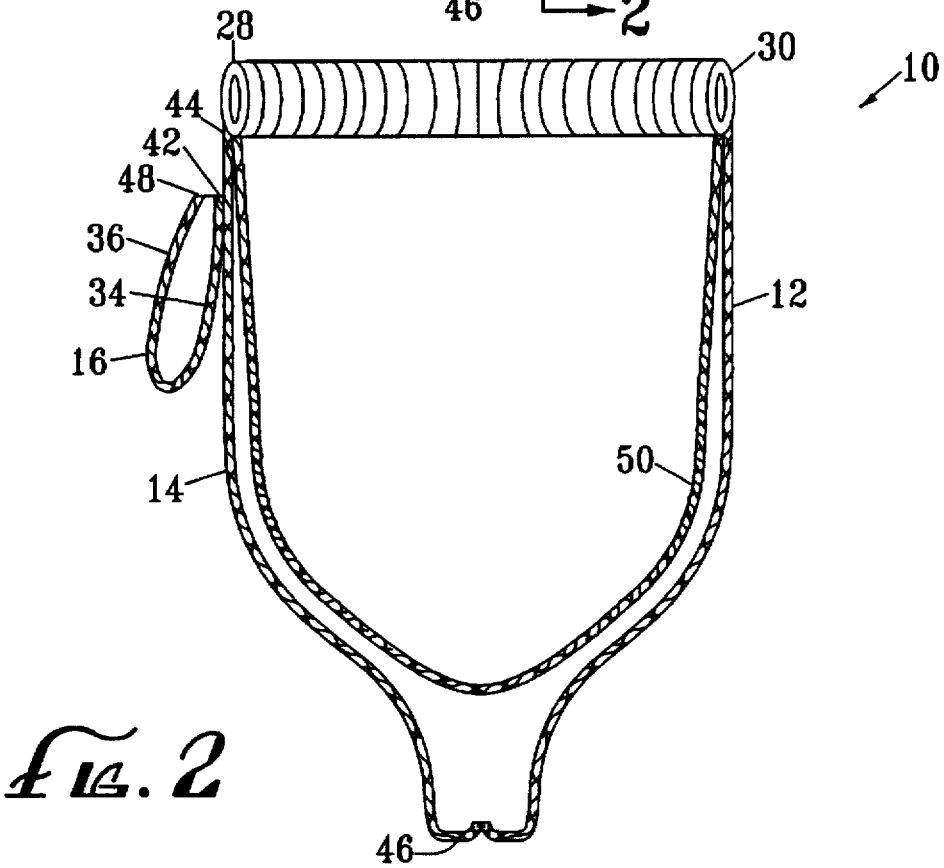
FIG. 2

ATHLETIC PANTS WITH BACK POCKET

BACKGROUND

Specially designed pants have been constructed for a variety of athletic activities, including running, rollerblading, skating and biking. While performing such sporting activities, it is often useful for athletes to carry items such as medicines, keys, money, sunglasses, energy bars or energy packets. For this purpose, an athlete will frequently wear a jersey having pockets for carrying such items, or will wear a pouch attached to his or her waist by a strap.

Pockets on jerseys, however, can restrict movement during sporting activities and items in jersey pockets tend to bounce against the athlete causing a degradation in performance. Further, athletes will often perform sports without wearing a jersey due to the high ambient temperature or to the restrictions in movement caused by jerseys. Further, pouches can affect the athletes' aerodynamics and can hinder movement during sports, disadvantageously affecting performance. Therefore, many athletic pants incorporate one or more pockets for holding items.

Pockets in athletic pants are of several types. Some pockets hold items between the outer layer of the pants and the athlete's skin. These pockets can cause the items to chafe during the sporting activity. Further, nutritional items can melt due to excessive heat generated by the athlete's body during the activity.

Other pockets in athletic pants are attached externally to the outer layer of the pants. These pockets tend to catch air during the athletic activity and, thus, degrade the athletes' performance. Further, items held by some external pockets tend to bounce excessively during the activity further affecting the athlete's performance. Also, item held by conventional pockets are difficult to retrieve, especially while performing activities involving running or jogging.

It would, therefore, be advantageous to have athletic pants that incorporate a pocket for carrying items, where the pocket does not subject the items to the extra heat generated by the athlete's body, that offer minimal resistance to air, and that minimize how much bounce the items are subjected to during the athletic activities. It would also be advantageous to have athletic pants that incorporate a pocket that allows for easy, convenient retrieval of items, particularly while performing athletic activities.

SUMMARY

The present invention is a pair of athletic pants that meets these needs. The athletic pants have at least one pocket attached to the back of the pants. The pocket has an inner layer and an outer layer, the inner layer being composed of mesh. In a preferred embodiment, the outer layer is also composed of mesh.

The pocket is attached to the back of the pants at the top edge of the inner layer, and preferably at the right and left edges of the pocket. The outer layer has an elastic strip incorporated into the top edge of the outer layer allowing for better retention of items within the pocket, particularly during sporting activities. The pants can be in the form of shorts, thigh-length, knee-length or full-length versions, as appropriate for the sporting activity.

FIGURES

These figures, aspects and advantages of the present invention will become better understood with regard to the following description, appended claims and accompanying figures where:

FIG. 1 is a back, left perspective view of athletic pants having features of the present invention; and FIG. 2 is a cross-sectional view of the athletic pants of FIG. 1 taken along line 2—2.

DESCRIPTION

In one embodiment, the present invention is a pair of athletic pants having at least one pocket connected to the back of the athletic pants, where the pocket is formed by an inner and outer layer of material, and where the inner layer of material comprises mesh. In another embodiment, both the inner and the outer layer of the pocket comprises mesh.

Referring now to FIGS. 1 and 2, there is shown a back, left perspective view of a pair of athletic pants 10 according to the present invention, and a side cross-sectional view of the pants 10 taken along line 2—2, respectively. As can be seen, the pants 10 comprise a front panel 12 and a back panel 14 and a pocket 16 affixed to the external surface of the back panel 14. The front panel 12 has a left edge 18, a right edge 20 and a top edge 22. Similarly, the back panel 14 has a left edge 24, a right edge 26, and a top edge 28. The left edge 18 of the front panel 12 is connected over at least part of its length to the back panel 14. Similarly, the right edge 20 of the front panel 12 is connected over at least part of its length to the back panel 14. Additionally, either the top edge of the front panel 22 or the top edge of the back panel 28 can comprise a waistband 30 that can be elasticized or can incorporate a drawstring to adjust the fit of the garment 10.

The athletic pants 10 further comprise at least one pocket 16 attached to the external surface of the back panel 14. In a preferred embodiment, the pocket 16 is subdivided into a plurality of pockets by one or more seams 32, such as the five smaller pockets shown in FIG. 1. In another preferred embodiment, the athletic pants comprise a plurality of separate pockets, each constructed according to the present invention.

As can be better appreciated in FIG. 2, the pocket 16 has an inner layer 34 adjacent the back panel 14 and an outer layer 36 external to the inner layer 34. In a preferred embodiment, the inner layer 34 is attached to the back panel 14 at a left edge 38, a right edge 40 and an upper edge 42. The pocket 16 can also be attached to the back panel 14 by the one or more seams 32, which serve to divide the pocket 16 into a plurality of smaller pockets. In a preferred embodiment, the upper edge 42 of the inner layer 34 is about 2 to 3 cm below the bottom edge 44 of the waistband 30, when present, or about 7 cm below the top edge 28 of the back panel 14. This arrangement allows items carried in the pocket 16 to rest on the upper portion of the gluteal region of the wearer for convenient access with either hand without disruption of athletic activity. Further, this arrangement provides a stable platform where relatively less movement occurs during sporting activities, and therefore subjects items within the pockets according to the present invention to less bouncing.

The inseam 46 of the pants 10 can be less than about 15 cm, as shown in the Figures, or can be long enough to cover the athlete's entire lower extremities, down to the ankle or including the foot. Alternately, the athletic pants 10 can have an inseam 46 at any intermediate length, such as is appropriate to cover some or all of the athlete's thigh, knee, or calf. As will be understood to those with skill in the art, different inseams serve to provide protection and retain heat as needed for various sporting activities and for various ambient temperatures.

The athletic pants 10 can comprise a variety of materials as will be understood by those with skill in the art. In a preferred embodiment, the back panel and the front panel are formed from a lightweight durable fabric such as nylon or polyester. The fabric can be a stretchable material such as a spandex combination fabric to provide a form fit for activities such as biking. Other materials such as SUPPLEX® (nylon fabric by DuPont) are also suitable.

The pocket 16 can comprise a variety of materials. In a preferred embodiment, the inner layer 34 is a mesh material. In a particularly preferred embodiment both the inner layer 34 and the outer layer 36 comprise a mesh material. Suitable mesh materials for the pocket include COOLMAX® (tetra-channel polyester fiber), Cyberknit, New York, N.Y.), nylon/spandex mesh (H. Warshow & Sons, New York, N.Y.), and polyester/spandex mesh (E.F.A., New York, N.Y.), nylon mesh (John King, Los Angeles, Calif.).

In a preferred embodiment, the mesh material is COOLMAX® mesh (DuPont's proprietary tetra-channel polyester fiber) available from Summit Knitting, New York, N.Y., and having holes in the mesh approximately 1 mm in diameter in the unstretched condition, with approximately 16 holes evenly spaced per $cm^2$. This fabric has approximately 10% stretch horizontally and 50% stretch vertically in the configuration used in the present invention. This configuration is particularly advantageous for decreasing the amount of bounce to which items in the pocket is subjected during sporting activities. Other types of mesh are also useful in the present invention. For example, mesh having holes approximately 0.25 to 2.0 mm in diameter, with between approximately 5 and 50 holes per $cm^2$ would also be within the scope of the present invention.

In a preferred embodiment, an elastic strip is incorporated into the upper edge 48 of the outer layer 36. The elastic preferably has a linear length without applied horizontal tension that is approximately 90% of the linear length of the upper edge 48 of the outer layer 36 under horizontal tension. This configuration tends to keep small objects fully within the pocket 16 and to more securely hold large objects in place that extend outside of the pocket 16. Further, the elastic allows for easy removal of items, unlike closures using VELCRO® (hook and loop fasteners) or zippers.

Athletic pants 10 having a pocket 16 according to the present invention have several advantages over conventional athletic pants with other types of pockets. First, the use of mesh for the pocket 16 adds minimal weight to the garment 10. Secondly, mesh allows air to pass through the pocket 16 thereby decreasing resistance or drag during the sporting activity. Further, liquids such as rain or sweat, tend to pass through the pocket 16 rather than accumulating within the pocket 16. Particularly advantageously, items within the pocket 16 tend to bounce less during sporting activities than items in conventional pockets, thereby having less of a negative effect on athletic performance. Also, items in pockets according to the present invention can be conveniently retrieved, particularly during activities involving running.

Although the present invention has been discussed in considerable detail with reference to certain preferred embodiments, other embodiments are possible. For example, the athletic pants 10 can further comprise an inner liner 50 that fits more closely against the athlete's body. Therefore, the spirit and scope of the appended claims should not be limited to the description of preferred embodiments contained herein.

I claim:

1. Athletic pants equipped with an expandable pocket structure, said athletic pants comprising:

a front panel formed with a set of left edge and right edge portions;

a back panel having an inner surface and an outer surface and formed with a left, right and top edge portion, said left and right edge portions of the front and back panels being at least partially attached along the respective edge portions, thereby enabling said panels to move freely, said pocket structure comprising:

an inner layer that extends laterally across the outer surface of the back panel and having left, right and top edge portions and is affixed at its left, right and top edge portions adjacent to the corresponding edge portions of the back panel, an outer layer that is coextensive with said inner layer forming an enclosure and including left and right edge portions affixed adjacent to the corresponding back panel edge portions;

whereby said pocket structure is free to expand upon having articles deposited therein without interfering with said front and back panels.

2. The athletic pants of claim 1, wherein the pocket structure is formed with multiple compartments.

3. Athletic pants equipped with an expendable pocket enclosure, said athletic pants comprising:

a front panel formed with left and right edge portions;

a back panel having a inner surface and an outer surface and formed with left, right and top edge portions, said left and right edge portions of the front and back panels being at least partially attached along the respective edge portions whereby said panels are enabled to move freely, said pocket enclosure comprising:

an outer layer formed by folding over a portion of the inner layer to form an enclosure that extends laterally across the back panel, said inner and outer layers having left and right edge portions and a top edge portion, with said left and right edge portions being affixed adjacent to the corresponding edge portions of the back panel, and said top edge portion of the inner layer being affixed to the top edge portion of the back panel, said inner and outer layers being formed of an expandable mesh fabric, whereby said pocket structure is free to expand upon having articles deposit therein without interfering with said front and back panels.

4. The athletic pants of claim 3, wherein the mesh has holes approximately 0.25 to 2.0 mm in diameter.

5. The athletic pants of claim 3, wherein the mesh has approximately 5 to 50 holes per $cm^2$.

6. The athletic pants of claim 3, wherein the front panel and the back panel form leg openings having an inseam, and wherein the inseam is less than about 15 cm.

7. The athletic pants of claim 3, wherein the outer layer has a top edge comprising an elasticized material.

8. The athletic pants of claim 3, wherein the top edge of the outer layer has a linear length under horizontal tension and wherein the elasticized material has a linear length without applied horizontal tension that is approximately 90% of the linear length of the top edge of the outer layer under horizontal tension.

9. The athletic pants of claim 3, wherein the pocket is at least 3 pockets.

* * * * *